US005738121A

United States Patent [19]

Westerveld et al.

[11] Patent Number: 5,738,121

[45] Date of Patent: Apr. 14, 1998

[54] HAIR STYLING BRUSH

[75] Inventors: Hendrik J. Westerveld; Albart J. Kip, both of Groningen, Netherlands

[73] Assignee: U.S. Philips Corporation, New York, N.Y.

[21] Appl. No.: 541,381

[22] Filed: Oct. 10, 1995

[30] Foreign Application Priority Data

Oct. 10, 1994 [EP] European Pat. Off. ..... 94202920

[51] Int. Cl.[6] ..... A45D 24/00; A45D 20/52

[52] U.S. Cl. ..... 132/113; 132/118; 132/142; 132/271

[58] Field of Search ..... 132/113, 114, 132/118, 141, 142, 269, 271; 219/222; 34/96, 97, 98, 101

[56] References Cited

U.S. PATENT DOCUMENTS

| | | | |
|---|---|---|---|
| D. 372,336 | 7/1996 | Kip | D28/18 |
| 724,178 | 3/1903 | Grant | 132/113 |
| 1,861,040 | 5/1932 | Williams | 219/222 |
| 2,073,970 | 3/1937 | Lynch | 132/114 |
| 3,696,818 | 10/1972 | Weber . | |
| 4,032,747 | 6/1977 | Kunz | 219/222 |
| 4,676,260 | 6/1987 | Paulhus et al. | 219/222 |
| 5,488,783 | 2/1996 | Parkinson et al. | 34/98 |

FOREIGN PATENT DOCUMENTS

| | | | |
|---|---|---|---|
| 2137407 | 1/1972 | Germany | 34/96 |
| 2947950 | 7/1981 | Germany . | |
| 24663 | of 1913 | United Kingdom | 34/97 |

*Primary Examiner*—Todd E. Manahan
*Assistant Examiner*—E. Robert
*Attorney, Agent, or Firm*—Ernestine C. Bartlett; Norman N. Spain

[57] ABSTRACT

A hair styling brush (1) for use in combination with a hot air source (12–14), comprising an elongate hollow body (2) with a row of hollow teeth (3), which extend substantially perpendicularly to the longitudinal axis (4) of the hollow body, the interior (5) of the hollow body being in open communication with the interior (6) of each of the hollow teeth, which hollow teeth (3) have outlet apertures (7, 8), through which in operation an air stream flows, which air stream is directed substantially perpendicularly to the longitudinal axis of the hollow body. To give the hair a maximal volume the brush is provided with a comb (9, 10) at either side of the row of hollow teeth (3), opposite the outlet apertures (7, 8).

4 Claims, 2 Drawing Sheets

HAIR STYLING BRUSH

BACKGROUND OF THE INVENTION

The invention relates to a hair styling brush for use in combination with a hot air source, comprising an elongate hollow body having a row of hollow teeth, which extend substantially perpendicularly to the longitudinal axis of the hollow body, the interior of the hollow body being in open communication with the interior of each of the hollow teeth, which hollow teeth have outlet apertures through which in operation an air stream flows, which air stream is directed substantially perpendicularly to the longitudinal axis of the hollow body.

Known hair styling brushes of this kind are used for hair drying and styling. The stream of hot air produced by the hot-air source is guided to the outlet apertures through the hollow body and the hollow teeth. An important aspect of this process is to give the hair more volume. However, with the known brushes this is achieved only to a limited degree, particularly because the hairs which lie flat at the hair implant are not adequately exposed to the hot air stream.

SUMMARY OF THE INVENTION

It is an object of the invention to provide a hair styling brush giving the greatest possible hair volume within a short drying time.

To this end the hair styling brush in accordance with the invention is characterised in that a comb is situated at either side of the row of hollow teeth, opposite the outlet apertures.

More hair volume is obtained by lifting the moist hair off the scalp and drying it as close as possible to the hair root. To use the hair styling brush in accordance with the invention the brush is placed in the hair onto the scalp, after which the brush is given a twisting movement. The leading comb, viewed in the direction of movement, then catches the moist hair, raises the hair and slightly stretches the hair. This results in the pores of the hairs being opened. The hot air from the outlet apertures, which are situated opposite the leading comb, viewed in the direction of movement, dries the hair at the hair implant. Since the pores of the hairs are open the hot air can properly penetrate into the hairs, so that the drying time is short. The hairs are fixed in their erect positions, which forms the basis for an increased hair volume. Subsequently, as the twisting movement of the brush proceeds the hairs are virtually flattened by the ends of the teeth and finally dried, in particular by the hot air from the trailing outlet apertures, viewed in the direction of movement, and are erected and styled by the trailing comb.

The invention also relates to a hair styling apparatus having a housing provided with means for producing a hot air stream and having a hair styling brush as described above, the hair styling brush being an attachment for the hair styling apparatus or being an integrated pan of the housing of the hair styling apparatus.

DETAILED DESCRIPTION OF THE INVENTION

Figure 1:
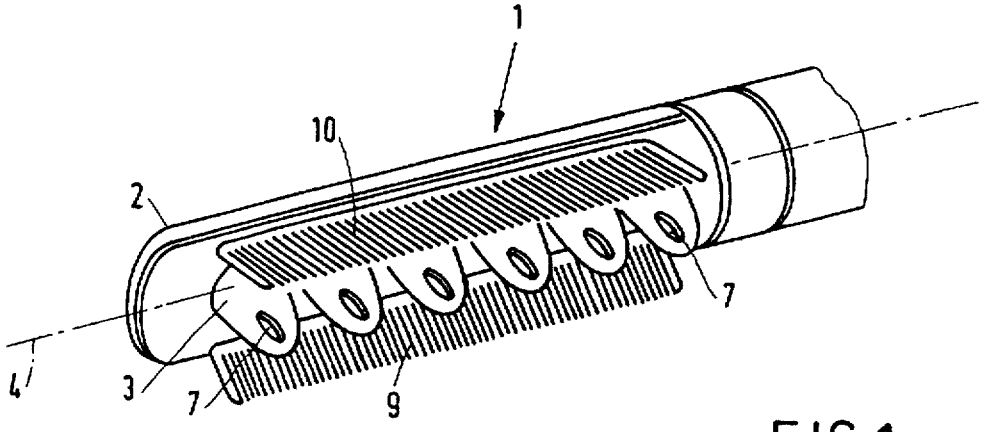
FIG. 1 shows a hair styling brush.
Figure 2:
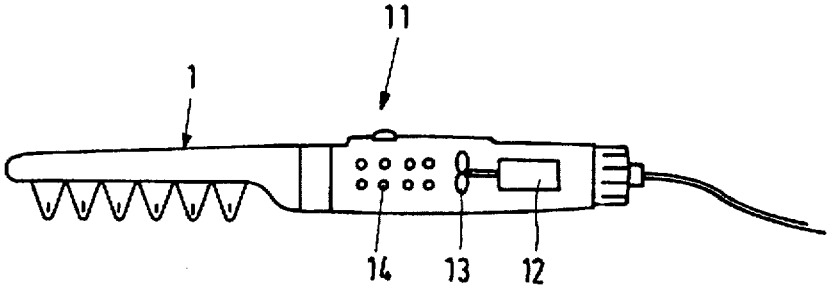
FIG. 2 shows a hair styling apparatus 11 provided with the hair styling brush shown in FIG. 1, FIGS. 3–6 are diagrammatic drawings illustrating the process of hair drying and styling by means of the hair styling brush.

The invention will now be described in greater detail with reference to the figures of the drawing.

The hair styling brush 1 is used in combination with a hot air source. The hot air source is formed by a motor 12, a fan 13 and a heating element 14. The hair styling brush 1 may be an attachment for a hair styling apparatus but may also be an integrated part of a hair styling apparatus.

The hair styling brush 1 has an elongate hollow body 2 (see also FIGS. 3–5) with a row of hollow teeth 3, which extend transversely of the longitudinal axis 4 of the hollow body 2. The interior 5 of the hollow body is in open communication with the interior 6 of each hollow tooth. Each hollow tooth has outlet apertures 7–8, which are disposed transversely of the longitudinal axis 4 of the hollow body. Combs 9 and 10 are situated each on one side of the row of hollow teeth 3.

Figure 3:
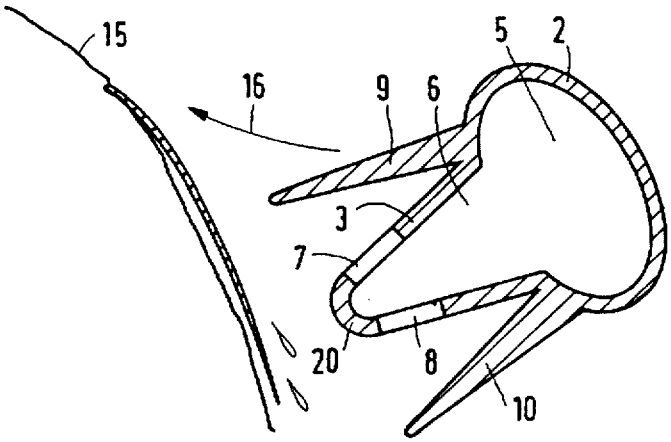
Figure 4:
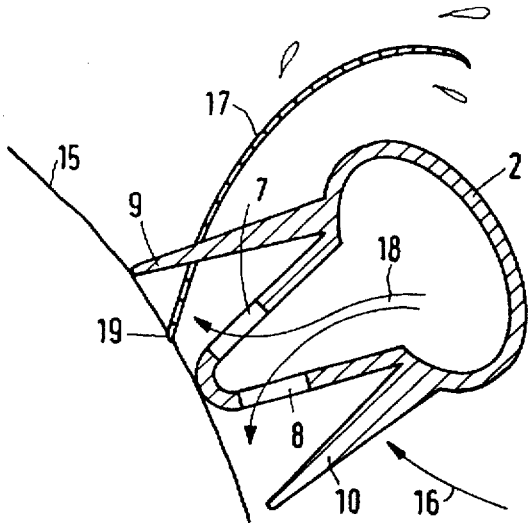
Figure 5:
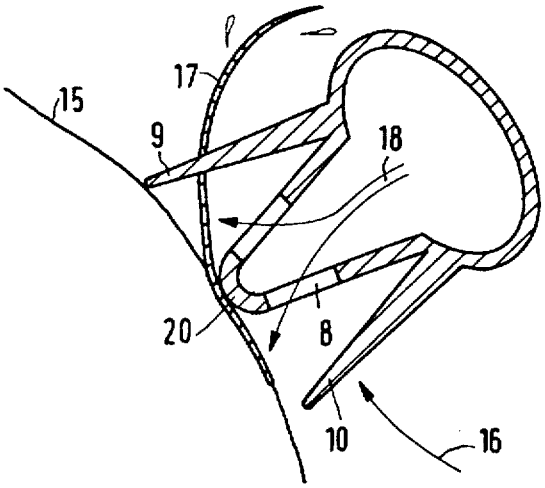
Figure 6:
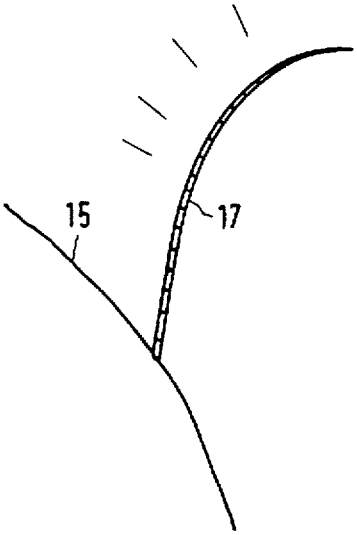

The method of hair drying and styling will now be described with reference to FIGS. 3–6. The hair styling brush is placed in the hair onto the scalp 15, after which the brush is given a twisting movement in the direction indicated by the arrow 16 (FIG. 3). The leading comb 9, viewed in the direction of movement 16, then catches the moist hair 17, raises the hair and slightly stretches the hair (FIG. 4). This results in the pores of the hairs being opened. The hot air 18 from the outlet apertures 7, which are situated opposite the leading comb 9, viewed in the direction of movement, dries the hair at the hair implant 19. Since the pores of the hairs are open the hot air can properly penetrate into the hairs, so that the drying time is short. The hairs are fixed in their erect positions, which forms the basis for an increased hair volume. FIG. 5 shows that as the twisting movement of the brush proceeds the hairs are virtually flattened by the ends 20 of the hollow teeth and finally dried, in particular by the hot air from the trailing outlet apertures 8, viewed in the direction of movement, and are erected and styled by the trailing comb 10. As a result, the hairs 17 are more erect relative to the scalp 15, thereby giving the hair more volume (FIG. 6).

In the present example the hair styling brush has only a small number of hollow teeth and the combs at opposite sides thereof have many teeth. It will be evident that the number of hollow teeth may be larger and the tooth pitch of the combs may be finer or coarser. Alternatively, the hair styling brush may be connected to a flexible hose which guides hot air from an external source.

We claim:

1. A hair styling brush for use in combination with a hot air source, comprising an elongate hollow body having a row of hollow teeth, which extend substantially perpendicularly to the longitudinal axis of the hollow body, the interior of the hollow body being in open communication with the interior of each of the hollow teeth, each of which hollow teeth has outlet apertures on opposing surfaces thereof for an air flow directed substantially perpendicularly to the longitudinal axis of the hollow body, characterised in that a row of solid prongs is situated at either side of the row of hollow teeth, opposite the outlet apertures.

2. The hair styling brush in claim 1 wherein said prongs extend outwardly from said row of hollow teeth.

3. A hair styling apparatus having a housing provided with a means for producing a hot air stream and a hair styling brush removably attached to said housing; said hair styling brush comprising an elongated hollow body having a row of hollow teeth which extend substantially perpendicularly to the longitudinal axis of the hollow body, the interior of the hollow body being in open communication with the interior of each of the hollow teeth and each hollow tooth having outlet apertures on opposing surfaces thereof such that said hot air stream directed substantially perpendicular to the longitudinal axis of the hollow body, and a row of solid prongs situated at either side of the row of hollow teeth, opposite the outlet apertures.

4. A hair styling apparatus having a housing provided with a means for producing a hot air stream and a hair styling brush integrated into said housing; said hair styling brush comprising an elongated hollow body having a row of hollow teeth which extend substantially perpendicularly to the longitudinal axis of the hollow body, the interior of the hollow body being in open communication with the interior of each of the hollow teeth and each hollow tooth having outlet apertures on opposing surfaces thereof such that said hot air stream directed substantially perpendicular to the longitudinal axis of the hollow body, and a row of solid prongs situated at either side of the row of hollow teeth, opposite the outlet apertures.

* * * * *